US011804174B1

(12) United States Patent
Li et al.

(10) Patent No.: US 11,804,174 B1
(45) Date of Patent: Oct. 31, 2023

(54) DISPLAY PANEL HAVING EVEN BRIGHTNESS, DRIVING CIRCUIT, AND DRIVING METHOD

(71) Applicant: HKC CORPORATION LIMITED, Shenzhen (CN)

(72) Inventors: Zeyao Li, Shenzhen (CN); Rongrong Li, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/954,334

(22) Filed: Sep. 28, 2022

(30) Foreign Application Priority Data

May 25, 2022 (CN) ..... 202210576558.9

(51) Int. Cl.
*G09G 3/30* (2006.01)
*G09G 3/32* (2016.01)

(52) U.S. Cl.
CPC ..... *G09G 3/32* (2013.01); *G09G 2300/0426* (2013.01); *G09G 2300/0842* (2013.01); *G09G 2310/0251* (2013.01); *G09G 2310/0264* (2013.01); *G09G 2310/08* (2013.01); *G09G 2320/0233* (2013.01); *G09G 2360/16* (2013.01)

(58) Field of Classification Search
CPC ..... G09G 3/32; G09G 2300/0426; G09G 2300/0842; G09G 2310/0251; G09G 2310/0264; G09G 2310/08; G09G 2320/0233; G09G 2360/16
See application file for complete search history.

(56) References Cited

U.S. PATENT DOCUMENTS

| | | | | |
|---|---|---|---|---|
| 11,164,494 | B1 * | 11/2021 | Hashimoto | G09G 3/3233 |
| 2006/0139253 | A1 * | 6/2006 | Choi | G09G 3/3233 345/76 |
| 2017/0186373 | A1 * | 6/2017 | Nishikawa | G09G 3/3258 |
| 2017/0193918 | A1 * | 7/2017 | Bae | G09G 3/3291 |
| 2019/0057649 | A1 | 2/2019 | Takizawa et al. | |

(Continued)

FOREIGN PATENT DOCUMENTS

| | | | |
|---|---|---|---|
| CN | 106847187 | A | 6/2017 |
| CN | 114519971 | A | 5/2022 |

OTHER PUBLICATIONS

Chinese first office action,Application No. 202210576558.9,dated Jul. 4, 2022(22 pages).

(Continued)

*Primary Examiner* — Sanghyuk Park

(57) ABSTRACT

Disclosed are a display panel, a driving circuit, and a driving method. The driving circuit includes multiple sub-pixels. For each sub-pixel, the sub-pixel includes: a light-emitting element; a pre-charging unit; a driving unit; and a detection unit. In condition of a detection operation being performed, the pre-charging unit is configured to receive the data driving signal, the driving unit is configured to generate a detection driving current, and the detection unit is configured to detect the detection driving current, such that the display panel determines and compensate a compensation signal; in condition of a display operation being performed, the pre-charging unit is configured to receive the compensated data driving signal, and the driving unit is configured to generate a display driving current to drive the light-emitting element to emit light.

20 Claims, 7 Drawing Sheets

(56) References Cited

U.S. PATENT DOCUMENTS

| | | | |
|---|---|---|---|
| 2019/0073954 | A1 | 3/2019 | Kuang et al. |
| 2020/0051496 | A1 | 2/2020 | Kang et al. |
| 2020/0193918 | A1 | 6/2020 | Hwang et al. |

OTHER PUBLICATIONS

Chinese Second office action,Application No. 202210576558.9,dated Jul. 21, 2022(10 pages).

* cited by examiner

| I1 (mA) | | Column | | | | |
|---|---|---|---|---|---|---|
| | | 1 | 2 | …… | N-1 | N |
| Row | 1 | I (1,1) | I (2,1) | …… | I (N-1,1) | I (N,1) |
| | 2 | I (1,2) | I (2,2) | …… | I (N-1,2) | I (N,2) |
| | …… | …… | …… | …… | …… | …… |
| | M-1 | I (1,M-1) | I (2,M-1) | …… | I (N-1,M-1) | I (N,M-1) |
| | M | I (1,M) | I (2,M) | …… | I (N-1,M) | I (N,M) |

| Grayscale X | | | | | | |
|---|---|---|---|---|---|---|
| V2 | | Column | | | | |
| | | 1 | 2 | …… | N-1 | N |
| Row | 1 | V2X (1,1) | V2X (2,1) | …… | V2X (N-1,1) | V2X (N,1) |
| | 2 | V2X (1,2) | V2X (2,2) | …… | V2X (N-1,2) | V2X (N,2) |
| | …… | …… | …… | …… | …… | …… |
| | M-1 | V2X (1,M-1) | V2X (2,M-1) | …… | V2X (N-1,M-1) | V2X (N,M-1) |
| | M | V2X (1,M) | V2X (2,M) | …… | V2X (N-1,M) | V2X (N,M) |

DISPLAY PANEL HAVING EVEN BRIGHTNESS, DRIVING CIRCUIT, AND DRIVING METHOD

CROSS REFERENCE

The present application claims priority of Chinese Patent Application No. 202210576558.9, filed on May 25, 2022, the entire contents of which are hereby incorporated by reference in its entirety.

TECHNICAL FIELD

The present disclosure relates to the field of display technologies, and in particular to a display panel, a driving circuit, and a driving method.

BACKGROUND

Inorganic micro light emitting diode (Micro LED) displays are currently one of the hot spots in the display research field. The inorganic Micro LED has the advantages of high reliability, low power consumption, high brightness, fast response, etc. Among them, a driving circuit configured to control a light-emitting element is the core technology content of the inorganic Micro LED display and has important research significance.

However, there are different driving currents of driving transistors at different positions and different times in the driving circuit, causing uneven brightness of the display panel.

SUMMARY OF THE DISCLOSURE

The present disclosure provides a display panel, a driving circuit, and a driving method, to solve the problem of uneven brightness of the display panel.

To solve the above technical problem, the present disclosure provides a driving circuit of a display panel, including a plurality of sub-pixels; wherein for each sub-pixel, the sub-pixel includes: a light-emitting element; a pre-charging unit, connected to a data line to receive a data driving signal; a driving unit, connected to the pre-charging unit and the light-emitting element; and a detection unit, connected to the driving unit; wherein in condition of a detection operation being performed, the pre-charging unit is configured to receive the data driving signal through the data line, the driving unit is configured to generate a detection driving current based on the data driving signal, and the detection unit is configured to detect the detection driving current generated by the driving unit, such that the display panel determines a compensation signal of the sub-pixel based on the detection driving current and compensates the data driving signal based on the compensation signal; in condition of a display operation being performed, the pre-charging unit is configured to receive the compensated data driving signal through the data line, and the driving unit is configured to generate a display driving current based on the compensated data driving signal to drive the light-emitting element to emit light.

In some embodiments, the sub-pixel further includes: a path control unit, connected between the driving unit and the light-emitting element; wherein in condition of the detection operation being performed, the path control unit is configured to disconnect a loop in which the driving unit and the light-emitting element are located, and the detection unit is configured to detect the detection driving current generated by the driving unit to enable the display panel to determine the compensation signal; in condition of the display operation being performed, the path control unit is configured to conduct the loop in which the driving unit and the light-emitting element are located, and the detection unit is in a high-impedance state; the driving unit is configured to generate the display driving current based on the compensated data driving signal, and the display driving current flows through the light-emitting element via the path control unit to drive the light-emitting element to emit light.

In some embodiments, the pre-charging unit is connected to a first scanning line to receive a first scanning signal, so as to control whether the pre-charging unit is turned on based on the first scanning signal; the detection unit is connected to a second scanning line to receive a second scanning signal, so as to control whether the detection unit is turned on based on the second scanning signal; a turn-on period of the second scanning signal is later than a turn-on period of the first scanning signal.

In some embodiments, in condition of the detection operation being performed, in a pre-charging stage, the pre-charging unit is turned on based on the first scanning signal to input the data driving signal to the driving unit and save the data driving signal, and the driving unit is configured to generate the detection driving current based on the data driving signal; in a detection stage, the detection unit is turned on based on the second scanning signal to output the detection driving current to a driving chip of the display panel through the detection line, thereby determining the compensation signal of the sub-pixel and compensating the data driving signal based on the compensation signal; in condition of the display operation being performed, in a compensation stage, the pre-charging unit is turned on based on the first scanning signal to input the compensated data driving signal to the driving unit and save the compensated data driving signal, and the driving unit is configured to generate the display driving current based on the compensated data driving signal to drive the light-emitting element to emit light; the driving chip of the display panel is in a high-impedance state during a period when the detection unit is turned on based on the second scanning signal.

In some embodiments, the pre-charging unit includes: a first switch, including a first terminal, a second terminal, and a control terminal; wherein the first terminal of the first switch is connected to the data line, the second terminal of the first switch is connected to the driving unit, and the control terminal of the first switch is configured to receive the first scanning signal.

In some embodiments, the driving unit includes: a second switch, including a first terminal, a second terminal, and a control terminal; wherein the first terminal of the second switch is connected to a first voltage source, the second terminal of the second switch is connected to the detection unit, and the control terminal of the second switch is connected to the pre-charging unit; and a capacitor, including a first terminal and a second terminal; wherein the first terminal of the capacitor is connected to the first terminal of the second switch, and the second terminal of the capacitor is connected to the control terminal of the second switch.

In some embodiments, the detection unit includes: a third switch, including a first terminal, a second terminal, and a control terminal; wherein the first terminal of the third switch is connected to the driving unit, the second terminal of the third switch is connected to the detection line, and the control terminal of the third switch is configured to receive the second scanning signal.

In some embodiments, the path control unit includes: a fourth switch, including a first terminal, a second terminal, and a control terminal; wherein the first terminal of the fourth switch is connected to the driving unit, the second terminal of the fourth switch is connected to the light-emitting element, and the control terminal of the fourth switch is configured to receive a control signal.

To solve the above technical problem, the present disclosure further provides a display panel, including: the driving circuit according to any one of claims 1-8; and a driving chip, connected to the driving circuit; wherein the driving chip is configured to obtain the detection driving current from the driving circuit, obtain the compensation signal based on the detection driving signal, and compensate the data driving signal based on the compensation signal.

To solve the above technical problem, the present disclosure further provides a driving method for a driving circuit, wherein the driving circuit includes a plurality of sub-pixels arranged in array, and the method includes: in condition of a detection operation being performed, scanning and detecting the plurality of sub-pixels row by row, and obtaining a detection driving current of each sub-pixel; determining a compensation signal of each sub-pixel based on the detection driving current of the each sub-pixel; and in condition of a display operation being performed, compensating a data driving signal of each sub-pixel based on the compensation signal of the each sub-pixel, so as to drive a light-emitting element of the each sub-pixel to emit light.

In contrast to the related art, the present disclosure provides a display panel, a driving circuit and a driving method. The driving circuit includes a light-emitting element; a pre-charging unit, connected to a data line to receive a data driving signal; a driving unit, connected to the pre-charging unit and the light-emitting element; and a detection unit, connected to the driving unit; wherein in condition of a detection operation being performed, the pre-charging unit is configured to receive the data driving signal through the data line, the driving unit is configured to generate a detection driving current based on the data driving signal, and the detection unit is configured to detect the detection driving current generated by the driving unit, such that the display panel determines a compensation signal of the sub-pixel based on the detection driving current and compensates the data driving signal based on the compensation signal; in condition of a display operation being performed, the pre-charging unit is configured to receive the compensated data driving signal through the data line, and the driving unit is configured to generate a display driving current based on the compensated data driving signal to drive the light-emitting element to emit light. By detecting and compensating the data driving signal of each sub-pixel before the display panel performs the display operation, the present disclosure solves the problem of uneven brightness of the display panel caused by the different driving currents of multiple sub-pixels at different positions and different times when the display panel performs the display operation.

BRIEF DESCRIPTION OF THE DRAWINGS

In order to more clearly illustrate the technical solutions in the embodiments of the present disclosure, a brief description of the accompanying drawings to be used in the description of the embodiments will be given below. It will be obvious that the accompanying drawings in the following description are only some embodiments of the present disclosure, and that other accompanying drawings may be obtained on the basis of these drawings without any creative effort for those skilled in the art.

Figure 1:
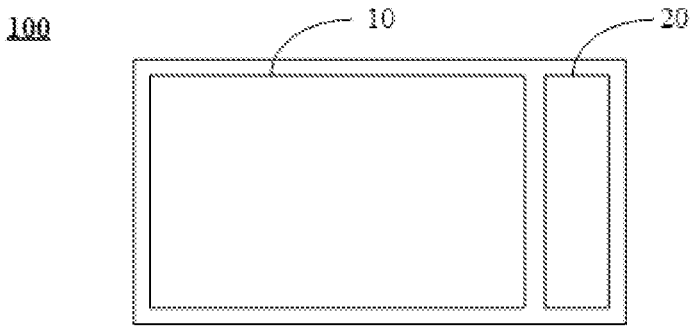
FIG. 1 is a structural schematic view of a display panel according to a first embodiment of the present disclosure.

Reference numerals description.

Display panel—100, driving circuit—10, driving chip—20, data driving signal—Vdata, detection driving current—I1, compensation signal—V2, sub-pixel—11, light-emitting element—111, pre-charging unit—112, driving unit—113, detection unit—114, path control unit—115, data line—12, detection line—13, first scanning line—L1, second scanning line—L2, display driving line—L3, third scanning line—L4, first scanning signal—Vscan 1, second scanning signal—Vscan 2, display signal—LC, third scanning signal—Vscan 4, first switch—T1, second switch—T2, third switch—T3, fourth switch—T4, fifth switch—T5, capacitor—C, first node—A, second node—B, detection data table—M1, compensation data table—M2, gray scale—X.

DETAILED DESCRIPTION

The technical solutions in the embodiments of the present disclosure will be clearly and completely described below with reference to the drawings in the embodiments of the present disclosure. Obviously, the described embodiments are only a part of the embodiments of the present disclosure, but not all of the embodiments. Based on the embodiments in the present disclosure, all other embodiments obtained by those skilled in the art without creative efforts shall fall within the scope of the present disclosure.

The inventors of the present disclosure have found that when the display panel performs a display operation, since a temporal change may exist in the characteristics of transistors in the driving circuit and the characteristics of the transistors at different positions may be different, driving currents of the transistors at different positions and at different times are different, resulting in unstable light emission of the light-emitting element, making the brightness of the display panel uneven and affecting user experience.

In order to solve the above problem, the present disclosure provides a display panel. Referring to FIG. 1, FIG. 1 is a structural schematic view of a display panel according to a first embodiment of the present disclosure. The display panel 100 includes a driving circuit 10 and a driving chip 20. The driving chip 20 is electrically connected to the driving circuit 10. The driving chip 20 is configured to obtain a detection driving current I1 of each sub-pixel 11 from the driving circuit 10, to obtain a compensation signal V2 based on the detection driving current I1, and to compensate a data driving signal Vdata based on the compensation signal V2, such that the display panel 100 performs a display operation with uniform brightness. Specifically, the driving circuit 10 includes a plurality of sub-pixels 11. Before the display panel 100 performs the display operation, the driving chip 20 detects and compensates the data driving signal Vdata of each sub-pixel 11, such that the display panel 100 has uniform brightness when performing a display operation. Specifically, the driving circuit 10 includes multiple sub-pixels 11, and the driving chip 20 is configured to detect and compensate the data driving signal Vdata of each sub-pixel 11 before the display panel 100 executes the display operation. In this way, when the display panel 100 performs the display operation, the driving current flowing through each sub-pixel 11 at different positions of the display panel 100 with the same gray level X is the same, thereby achieving uniform brightness of the display panel 100.

Figure 2:
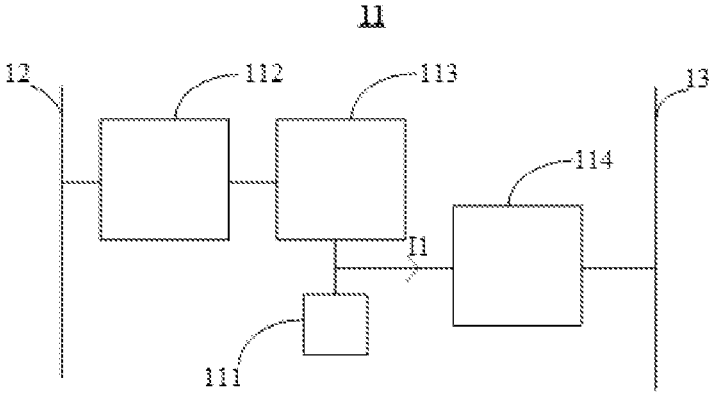
FIG. 2 is a schematic view of a circuit module of a sub-pixel in a driving circuit according to the first embodiment of the present disclosure.

Referring to FIG. 2, FIG. 2 is a schematic view of a circuit module of a sub-pixel in a driving circuit according to the first embodiment of the present disclosure. The driving circuit 10 includes multiple sub-pixels 11, and each sub-pixel 11 includes a light-emitting element 111, a pre-charging unit 112, a driving unit 113, and a detection unit 114. Specifically, the pre-charging unit 112 is connected to a data line 12 to receive the data driving signal Vdata; the driving unit 113 is connected to the pre-charging unit 112 and the light-emitting element 111; the detection unit 114 is connected to the driving unit 113. When a detection operation is performed, the pre-charging unit 112 is configured to receive the data driving signal Vdata through the data line 12, the driving unit 113 is configured to generate a corresponding detection driving current I1 based on the data driving signal Vdata, and the detection unit 114 is configured to detect the detection driving current I1 generated by the driving unit 113, such that the display panel 100 determines the compensation signal V2 of the sub-pixel 11 based on the detection driving current I1 and compensates the data driving signal Vdata based on the compensation signal V2. When the display operation is performed, the pre-charging unit 112 is configured to receive the compensated data driving signal Vdata through the data line 12, and the driving unit 113 is configured to generate a corresponding display driving current based on the compensated data driving signal Vdata to drive the light-emitting element 111 to emit light.

Specifically, before the display panel 100 performs the display operation, the driving chip 20 may scan and detect the sub-pixels 11 row by row or column by column to obtain the detection driving current I1 of each sub-pixel 11. For example, before the display panel 100 displays a normal image on every startup, the driving chip 20 is connected to the detection unit 114 through the detection line 13 and performs a calculation based on the detection driving current I1, which is generated by the driving unit 113, detected through the detection unit 114 in combination with an algorithm, thereby obtaining grayscales X of the sub-pixels 11 at different positions on the display panel 100. The driving chip 20 may compensate any grayscale X to achieve the same driving current flowing through the light-emitting element 111 when the display panel 100 performs the display operation, thereby realizing the same grayscale X at different positions to achieve uniform brightness display. Of course, every fixed time duration, before the display panel 100 displays a next screen, the driving chip 20 may compensate the detection driving current I1, which is generated by the driving unit 113, detected through the detection unit 114, so as to ensure that the driving current of the light-emitting elements 111 at different positions is compensated, but also to ensure that the current of the light-emitting elements 111 at different times is compensated.

Figure 3:
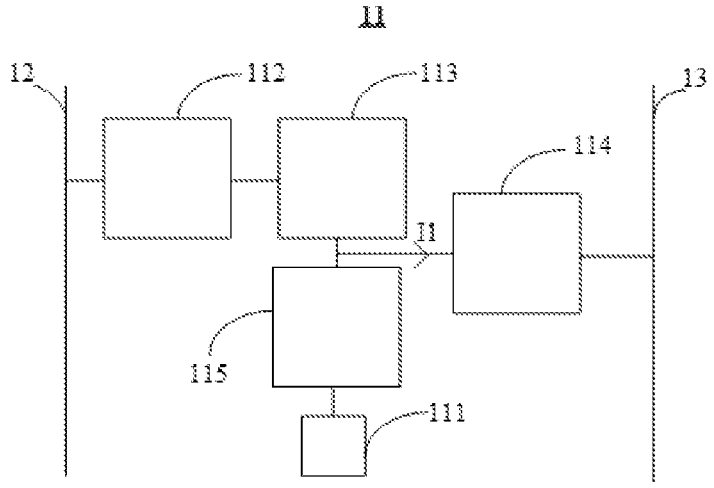
FIG. 3 is a schematic view of a circuit module of a sub-pixel in a driving circuit according to a second embodiment of the present disclosure.

Referring to FIG. 3, FIG. 3 is a schematic view of a circuit module of a sub-pixel in a driving circuit according to a second embodiment of the present disclosure. The driving circuit 10 includes multiple sub-pixels 11, and each sub-pixel 11 includes a light-emitting element 111, a pre-charging unit 112, a driving unit 113, a detection unit 114, and a path control unit 115. The difference of this embodiment compared to the first embodiment is that each sub-pixel 11 further includes the path control unit 115. The path control unit 115 is connected between the driving unit 113 and the light-emitting element 111. When the detection operation is performed, the path control unit 115 is configured to disconnect a loop in which the driving unit 113 and the light-emitting element 111 are located, and the detection unit 114 is configured to detect the detection driving current I1 generated by the driving unit 113 to enable the display panel 100 to determine the compensation signal V2. When the display operation is performed, the path control unit 115 is configured to conduct the loop in which the driving unit 113 and the light-emitting element 111 are located, and the detection unit 114 is placed in a high-impedance state; the driving unit 113 is configured to generate a corresponding display driving current based on the compensated data driving signal Vdata, and the display driving current flows through the light-emitting element 111 through the conducting path control unit 115 to drive the light-emitting element 111 to emit light. In the present disclosure, by connecting the path control unit 115 between the driving unit 113 and the light-emitting element 111, the path control unit 115 is turned on when the detection operation is performed, such that the light-emitting element 111 does not emit light; when the display operation is performed, the path control unit 115 is turned off, the light-emitting element 111 emits light, and the current flowing through the light-emitting element 111 is the compensated current, such that the brightness of the display panel 100 is uniform.

In this embodiment, the pre-charging unit 112 is connected to a first scanning line L1 to receive a first scanning signal Vscan 1, so as to control whether the pre-charging unit 112 is turned on based on the first scanning signal Vscan 1; the detection unit 114 is connected to a second scanning line L2 to receive a second scanning signal Vscan 2, so as to control whether the detection unit 114 is turned on based on the second scanning signal Vscan 2; and the path control unit 115 is connected to a display driving line L3 to receive a display signal LC, so as to determine whether the path control unit 115 is turned on based on the display signal LC. A turn-on period of the second scanning signal Vscan 2 is later than a turn-on period of the first scanning signal Vscan 1, and the display driving line L3 is configured to output the display signal LC when the display operation is performed, that is, a turn-on period of the display signal LC is later than the turn-on period of the second scanning signal Vscan 2. Specifically, in a pre-charging stage of the detection operation, the detection unit 114 and the path control unit 115 are turned off, the first scanning signal Vscan 1 controls the pre-charging unit 112 to be turned on to receive the data driving signal Vdata, and the driving unit 113 generates the detection driving current I1 based on the data driving signal Vdata. In a detection stage of the detection operation, the first scanning signal Vscan 1 controls the pre-charging unit 112 to be turned off, the second scanning signal Vscan 2 controls the detection unit 114 to be turned on, and the detection unit 114 detects the detection driving current I1 generated by the driving unit 113 to determine the compensation signal V2. In a first stage of performing the display operation, that is, a compensation stage, the detection unit 114 and the path control unit 115 are turned off, the first scanning signal Vscan 1 controls the pre-charging unit 112 to be turned on, the pre-charging unit 112 receives the compensated data driving signal Vdata, and the driving unit 113 generates the display driving current based on the compensated data driving signal Vdata. In a second stage, the first scanning signal Vscan 1 controls the pre-charging unit 112 to be turned off, and the second scanning signal Vscan 2 controls the detection unit 114 to be turned on, such that the driving chip 20 is in a high-impedance state. In a third stage of performing the display operation, that is, a display stage, the first scanning signal Vscan 1 controls the pre-charging unit 112 to be turned off, the second scanning signal Vscan 2 controls the detection unit 114 to be turned off, and the display signal LC controls the path control unit 115 to be turned on, such that the light-emitting element 111 emits light, and the current flowing through the light-emitting element 111 is the compensated current.

In this embodiment, when the detection operation is performed, in the pre-charging stage, the pre-charging unit 112 is turned on based on the first scanning signal Vscan 1 to input the data driving signal Vdata to the driving unit 113 and save the signal, and the driving unit 113 generates the corresponding detection driving current I1 based on the data driving signal Vdata; in the detection stage, the detection unit 114 is turned on based on the second scanning signal Vscan 2 to output the detection driving current I1 to the driving chip 20 of the display panel 100 through the detection line 13, thereby determining the compensation signal V2 of the sub-pixel 11, and the data driving signal Vdata is compensated by the compensation signal V2. When the display operation is performed, in the compensation stage, the pre-charging unit 112 is turned on based on the first scanning signal Vscan 1 to input the compensated data driving signal Vdata to the driving unit 113 and save the signal, and the driving unit 113 is configured to generate a corresponding display driving current based on the compensated data driving signal Vdata to drive the light-emitting element 111 to emit light.

When the display operation is performed, the driving chip 20 of the display panel 100 is in a high-impedance state during a period when the detection unit 114 is turned on based on the second scanning signal Vscan 2, which is equivalent to an open-circuit state between the driving circuit 10 and the driving chip 20 to avoid affecting the light-emitting element 111 to emit light. In this embodiment, the first scanning signal Vscan 1 and the second scanning signal Vscan 2 may be scanning signals respectively provided by two adjacent scanning lines, that is, an enabling period of the second scanning signal Vscan 2 may follow an enabling period of the first scanning signal Vscan 1. In addition, an enabling period of the display signal LC may be later than the enabling period of the first scanning signal Vscan 1 and the enabling period of the second scanning signal Vscan 2. In this way, when the display operation is performed, during the enabling period of the display signal LC, the path control unit 115 is turned on and the light-emitting element 111 emits light.

Figure 4:
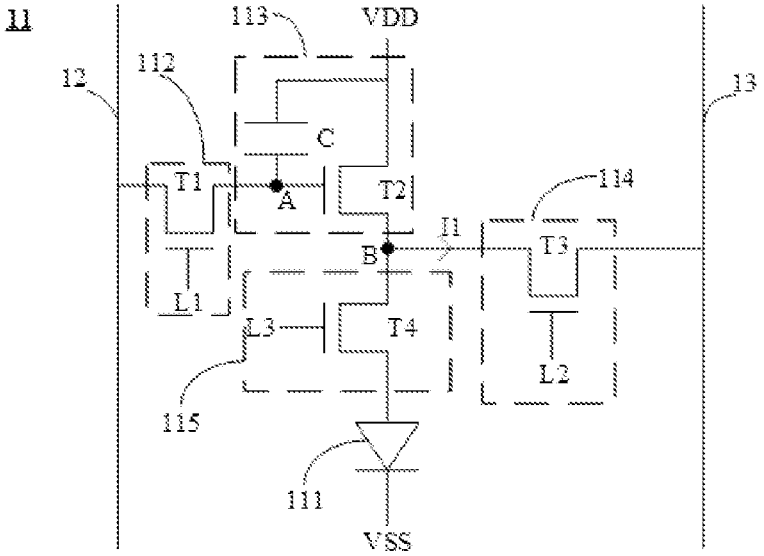
FIG. 4 is a specific circuit schematic view of the sub-pixel as shown in FIG. 3.
Figure 5:
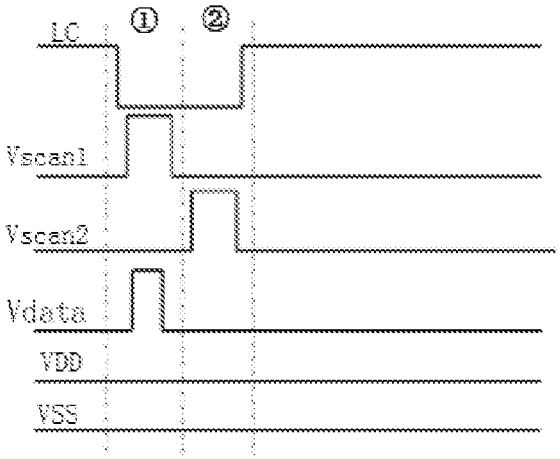
FIG. 5 is a timing diagram of a driving circuit when performing a detection operation according to the second embodiment of the present disclosure.

Referring to FIG. 4, FIG. 4 is a specific circuit schematic view of the sub-pixel as shown in FIG. 3. Specifically, the pre-charging unit 112 may include a first switch T1, the first switch T1 including a first terminal, a second terminal, and a control terminal. The first terminal of the first switch T1 is connected to the data line 12, the second terminal of the first switch T1 is connected to the driving unit 113, and the control terminal of the first switch T1 is configured to receive the first scanning signal Vscan 1. A connection point between the driving unit 113 and the pre-charging unit 112 is defined as a first node A. The driving unit 113 includes a second switch T2 and a capacitor C, the second switch T2 including a first terminal, a second terminal, and a control terminal. The first terminal of the second switch T2 is connected to a first voltage source VDD, the second terminal of the second switch T2 is connected to the detection unit 114, and the control terminal of the second switch T2 is connected to the pre-charging unit 112. The capacitor C includes a first terminal and a second terminal, the first terminal of the capacitor C being connected to the first terminal of the second switch T2, and the second terminal of the capacitor C being connected to the control terminal of the second switch T2. A connection point between the driving unit 113 and the detection unit 114 is defined as a second node B. The detection unit 114 includes a third switch T3, the third switch T3 including a first terminal, a second terminal, and a control terminal. The first terminal of the third switch T3 is connected to the driving unit 113, the second terminal of the third switch T3 is connected to the detection line 13, and the control terminal of the third switch T3 is configured to receive the second scanning signal Vscan 2. The path control unit 115 includes a fourth switch T4, the fourth switch T4 including a first terminal, a second terminal, and a control terminal. The first terminal of the fourth switch T4 is connected to the driving unit 113, the second terminal of the fourth switch T4 is connected to a first terminal of the light-emitting element 111, a second terminal of the light-emitting element 111 is connected to a second voltage source VSS, and the control terminal of the fourth switch T4 is configured to receive a control signal, that is, the display signal LC. The first terminal of the light-emitting element 111 is connected to the path control unit 115, and the second terminal of the light-emitting element 111 is connected to the second voltage source VSS.

The light-emitting element 111 may be a light-emitting diode (LED); the first switch T1, the second switch T2, the third switch T3, and the fourth switch T4 may all be N-type transistors or P-type transistors. Alternatively, at least one of the first switch T1, the second switch T2, the third switch T3, and the fourth switch T4 may be each an N-type transistor, and the other may be each a P-type transistor. The present disclosure takes them as N-type transistors as an example for description.

Figure 6:
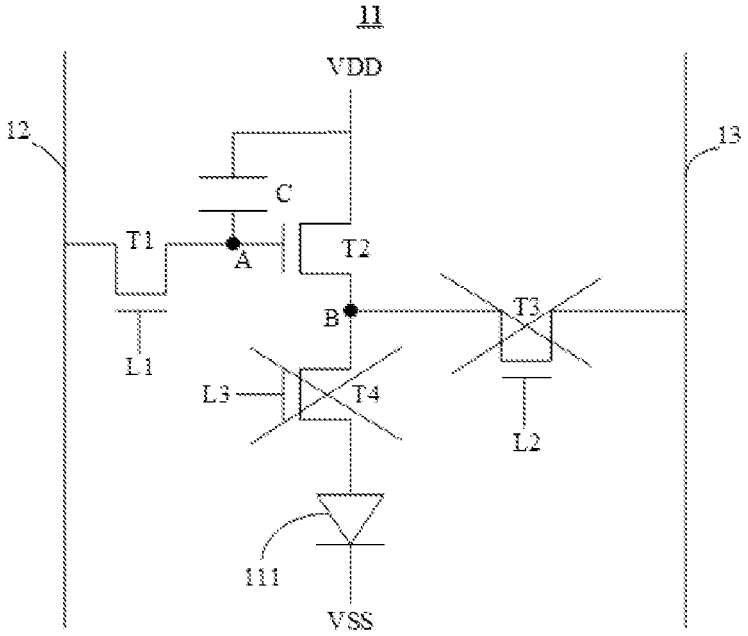
FIG. 6 is an on-off schematic view of switches in a driving circuit in a pre-charging state when performing a detection operation according to the second embodiment of the present disclosure.
Figure 7:
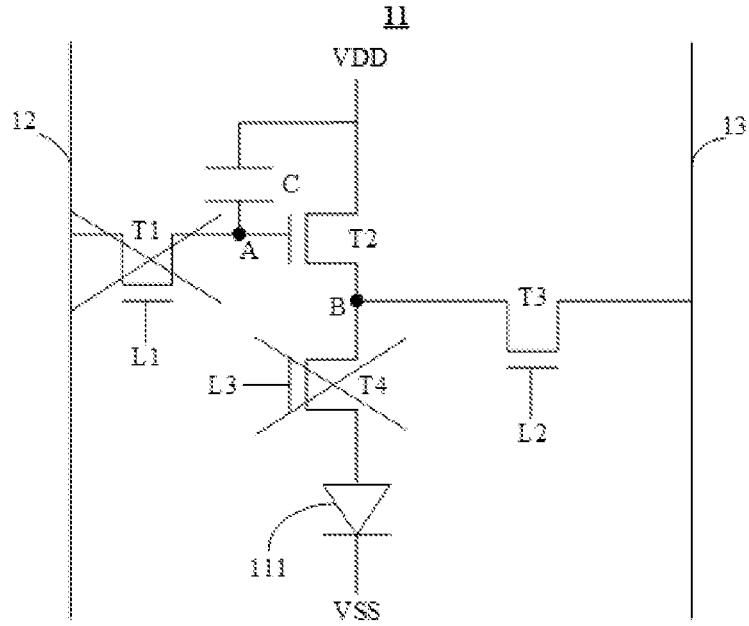
FIG. 7 is an on-off schematic view of switches in a driving circuit in a detection state when performing a detection operation according to the second embodiment of the present disclosure.
Figures 8, 9, 10:
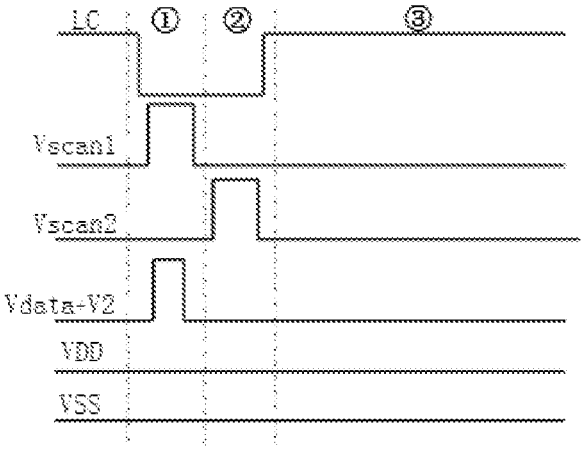
FIG. 8 is a schematic view of a detection data table formed by a driving chip after a driving circuit performing a detection operation according to the second embodiment of the present disclosure.
FIG. 9 is a schematic view of a compensation data table formed by a driving chip after a driving circuit performing a detection operation according to the second embodiment of the present disclosure.
FIG. 10 is a timing diagram when a driving circuit performing a display operation according to the second embodiment of the present disclosure.

Referring to FIGS. 4 to 7, FIG. 5 is a timing diagram of a driving circuit when performing a detection operation according to the second embodiment of the present disclosure, FIG. 6 is an on-off schematic view of switches in a driving circuit in a pre-charging state when performing a detection operation according to the second embodiment of the present disclosure, and FIG. 7 is an on-off schematic view of switches in a driving circuit in a detection state when performing a detection operation according to the second embodiment of the present disclosure. Specifically, in the pre-charging stage ① of the detection operation, the first scanning signal Vscan 1 is at a high voltage, the first switch T1 is turned on, and the data line 12 outputs the data driving signal Vdata; for example, the data line 12 outputs a predetermined voltage, and the data driving signal Vdata is written into the first node A through the first switch T1; the second scanning signal Vscan 2 is at a low voltage, the third switch T3 is turned off, and the fourth switch T4 receives the control signal and is turned off; no current flows through the second node B. In the detection phase ② of the detection operation, the first scanning signal Vscan 1 is at a low voltage, the first switch T1 is turned off, the data driving signal Vdata of the first node A is stored in the capacitor C, the second scanning signal Vscan 2 is at a high voltage, the third switch T3 is turned on, and the second switch T2 is controlled by the data driving signal Vdata to be turned on; there is current flowing through the second node B, which is the detection driving current I1; the driving chip 20 detects the detection driving current I1 through the detection line 13, and the fourth switch T4 is still turned off after receiving the control signal; the light emitting element 111 does not emit light. Referring to FIG. 8, FIG. 8 is a schematic view of a detection data table formed by a driving chip after a driving circuit performing a detection operation according to the second embodiment of the present disclosure. By performing the two-stage detection operation, a row-by-row scanning detection of the multiple sub-pixels 11 is realized, such that the detection driving currents I1 of all sub-pixels 11 in the entire display panel 100 may be detected and recorded in the driving chip 20, and a detection data table M1 is thus formed.

Further, referring to FIG. 9, FIG. 9 is a schematic view of a compensation data table formed by a driving chip after a driving circuit performing a detection operation according to the second embodiment of the present disclosure. The driving chip 20 performs a calculation based on the detection driving current I1 in combination with an algorithm to obtain grayscales X of the sub-pixels 11 at different positions on the display panel 100. For any grayscale X, the compensation signal V2 of the sub-pixel 11 is determined, and the driving chip 20 compensates the data driving signal Vdata by the compensation signal V2 to form a compensation data table M2, such that when the display panel 100 performs the display operation, the currents flowing through the light-emitting elements 111 are the same when the grayscales X at different positions are the same, so as to realize uniform display brightness. Specifically, when the data driving signal Vdata is input to the driving chip 20, the driving chip 20 may compensate a compensation voltage into the data driving signal Vdata, such that the driving chip 20 may realize voltage compensation on the first nodes A in the sub-pixels at different positions of the display panel 100. In this way, when the display operation is performed, the currents flowing through the light-emitting elements 111 are the same when the grayscales X at different positions are the same, so as to realize uniform display brightness.

Figure 11:
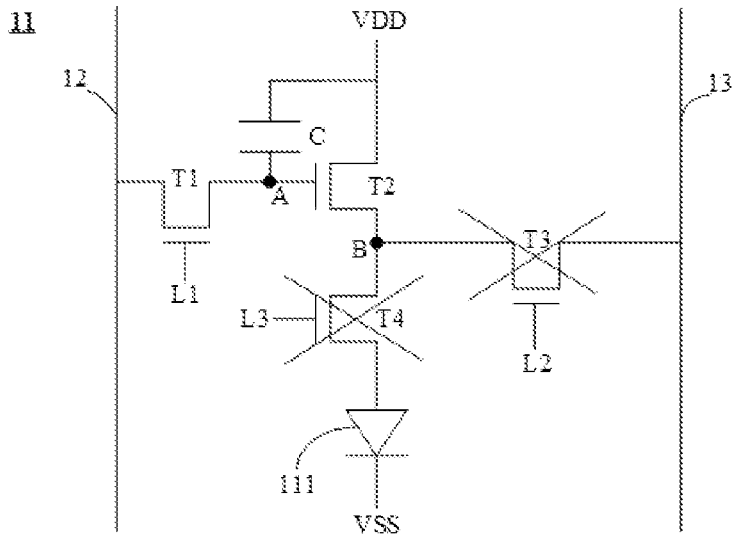
FIG. 11 is an on-off schematic view of switches in a driving circuit in a first state when performing a display operation according to the second embodiment of the present disclosure.
Figure 12:
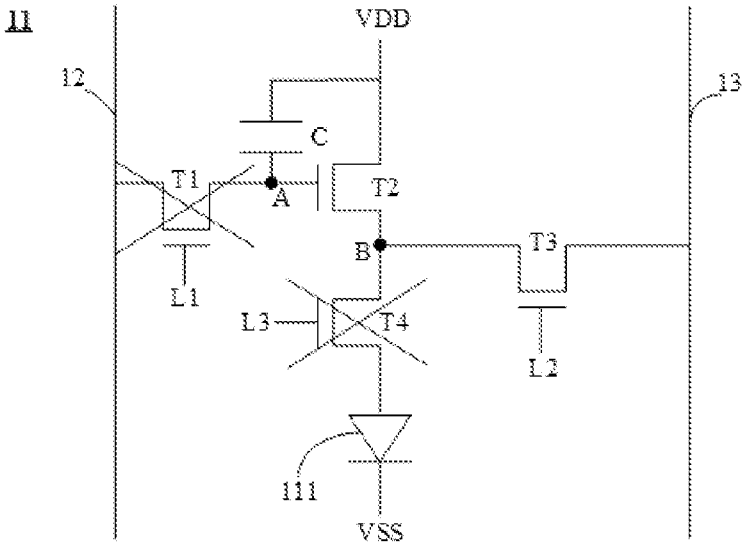
FIG. 12 is an on-off schematic view of switches in a driving circuit in a second state when performing a display operation according to the second embodiment of the present disclosure.
Figure 13:
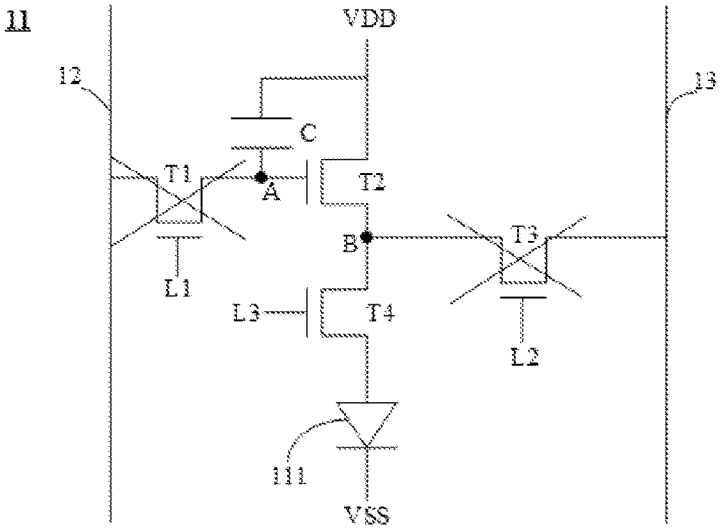
FIG. 13 is an on-off schematic view of switches in a driving circuit in a third state when performing a display operation according to the second embodiment of the present disclosure.

Referring to FIGS. 10-13, FIG. 10 is a timing diagram when a driving circuit performing a display operation according to the second embodiment of the present disclosure, FIG. 11 is an on-off schematic view of switches in a driving circuit in a first state when performing a display operation according to the second embodiment of the present disclosure, FIG. 12 is an on-off schematic view of switches in a driving circuit in a second state when performing a display operation according to the second embodiment of the present disclosure, and FIG. 13 is an on-off schematic view of switches in a driving circuit in a third state when performing a display operation according to the second embodiment of the present disclosure. Specifically, in the first stage ① of the display operation, the first scanning signal Vscan 1 is at a high voltage, the first switch T1 is turned on, and the data driving signal Vdata is compensated; the second scanning signal Vscan 2 is at a low voltage, the third switch T3 is turned off, the fourth switch T4 is turned off after receiving the control signal, and the light-emitting element 111 does not emit light. In the second stage ② of the display operation, the first scanning signal Vscan 1 is at a low voltage, the first switch T1 is turned off, the second scanning signal Vscan 2 is at a high voltage, the third switch T3 is turned on, and the second switch T2 is controlled by the data driving signal Vdata to be turned on; the display driving current flows through the second node B, the detection unit 114 is turned on based on the second scanning signal Vscan 2 during a period when the driving chip 20 is in a high impedance state, and the light-emitting element 111 does not emit light. In the third stage ③ of the display operation, the first scanning signal Vscan 1 and the second scanning signal Vscan 2 are both at low voltages, the first switch T1 and the third switch T3 are turned off, and the fourth switch T4 receives the control signal and is turned on; the display driving current flows through the light-emitting element 111, the light-emitting element 111 emits light with a compensated brightness.

Figure 14:
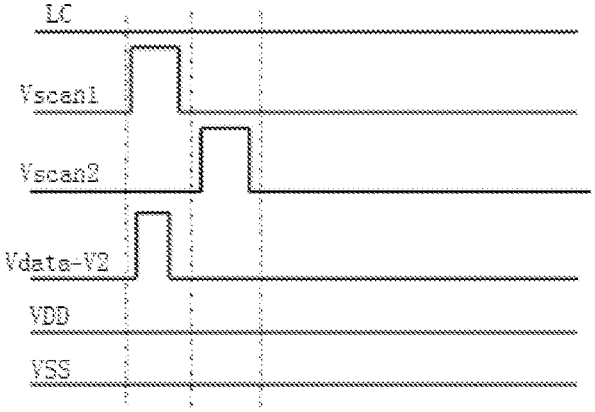
FIG. 14 is a timing diagram when a driving circuit performing a display operation according to a third embodiment of the present disclosure.

In some embodiments, referring to FIG. 14, FIG. 14 is a timing diagram when a driving circuit performing a display operation according to a third embodiment of the present disclosure. The structure of the driving circuit 10 provided in this embodiment is basically the same as that of the driving circuit 10 provided in the second embodiment. The difference is that the control signal received by the control terminal of the fourth switch T4 in this embodiment is adopted with a relatively simple direct-current (DC) signal. That is, when the detection operation and the compensation operation are performed, the control signal received by the control terminal of the fourth switch T4 is at a DC low voltage, and when the display operation is performed, the control signal received by the control terminal of the fourth switch T4 is at a DC high voltage.

Figure 15:
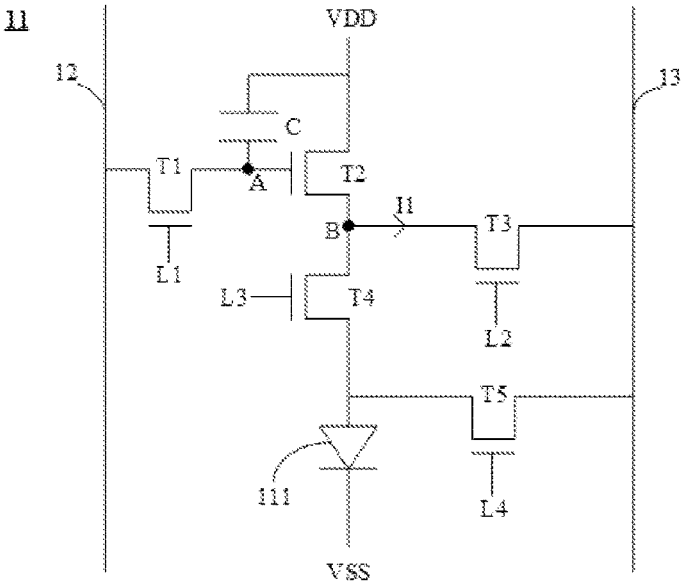
FIG. 15 is a specific circuit schematic view of a sub-pixel according to a fourth embodiment of the present disclosure.

In some embodiments, referring to FIG. 15, FIG. 15 is a specific circuit schematic view of a sub-pixel according to a fourth embodiment of the present disclosure. In order to avoid the influence of the fourth switch T4 on the display driving current, the difference between this embodiment and the second embodiment is that each sub-pixel 11 in this embodiment further includes a fifth switch T5 and a third scanning line L4. The fifth switch T5 includes a first terminal, a second terminal, and a control terminal, the first terminal of the fifth switch T5 being connected to the second terminal of the fourth switch T4, the second terminal of the fifth switch T5 being connected to the detection line 13, and the control terminal being connected to the third scanning line L4 to receive a third scanning signal Vscan 4. The third scanning signal Vscan 4 is configured to control the fifth switch T5 to be turned on. Specifically, when the fourth switch T4 is turned on, the third scanning signal Vscan 4 controls the fifth switch T5 to be turned on, the fifth switch T5 detects the display driving current, and the fifth switch T5 is turned on based on the third scanning signal Vscan 4 to output the display driving current to the driving chip 20 through the detection line 13, thereby determining whether the display driving current is a preset display driving current. When the driving chip 20 detects the display driving current, the fifth switch T5 is turned off based on the third scanning signal Vscan4 to avoid affecting the light-emitting element 111 to emit light. It can be understood that when the driving chip 20 detects that the display driving current is different from the preset display driving current, the driving chip 20 may further perform a calculation in combination with an algorithm to obtain grayscales X of the sub-pixels 11 at different positions on the display panel 100. The driving chip 20 may compensate any grayscale X such that when the display panel 100 performs a next-frame display operation, the currents flowing through the light-emitting elements 111 are the same when the grayscales X at different positions are the same, so as to achieve uniform display brightness.

The driving circuit 10 of the display panel 100 provided by the present disclosure includes multiple sub-pixels 11, and each sub-pixel 11 includes a light-emitting element 111, a pre-charging unit 112, a driving unit 113, and a detection unit 114. Specifically, the pre-charging unit 112 is connected to a data line 12 to receive a data driving signal Vdata; the driving unit 113 is connected to the pre-charging unit 112 and the light-emitting element 111; the detection unit 114 is connected to the driving unit 113. When a detection operation is performed, the pre-charging unit 112 receives the data driving signal Vdata through the data line 12, the driving unit 113 generates a corresponding detection driving current I1 based on the data driving signal Vdata, and the detection unit 114 detects the detection driving current I1 generated by the driving unit 113, thereby enabling the display panel 100 to determine a compensation signal V2 of the sub-pixel 11 based on the detection driving current I1 and to compensate the data driving signal Vdata by the compensation signal V2; when a display operation is performed, the pre-charging unit 112 receives the compensated data driving signal Vdata through the data line 12, and the driving unit 113 generates a corresponding display driving current based on the compensated data driving signal Vdata, thereby driving the light-emitting element 111 to emit light. In this way, the problem of uneven brightness of the display panel 100 caused by different driving currents of multiple sub-pixels 11 at different positions and at different times when the display panel 100 performs a display operation is solved.

Figure 16:
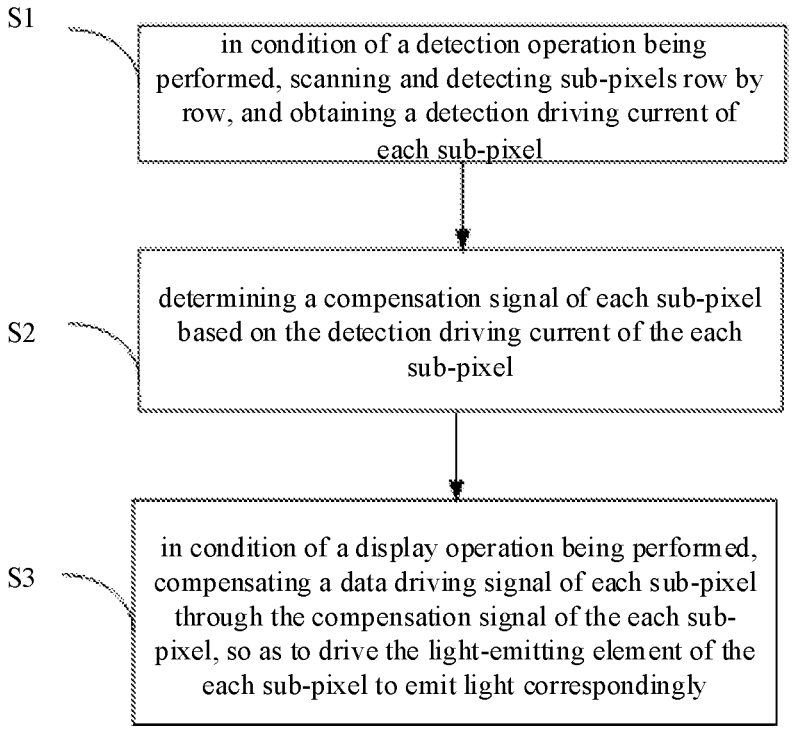
FIG. 16 is a flowchart of a driving method for a driving circuit according to a fifth embodiment of the present disclosure.

Referring to FIG. 16, FIG. 16 is a flowchart of a driving method for a driving circuit according to a fifth embodiment of the present disclosure. The method includes operations at blocks illustrated herein.

At block S1: in condition of a detection operation being performed, scanning and detecting sub-pixels row by row, and obtaining a detection driving current of each sub-pixel.

Specifically, when the detection operation is performed, in a pre-charging stage, the pre-charging unit is turned on based on the first scanning signal Vscan to input the data driving signal to the driving unit and save the signal, and the driving unit generates the corresponding detection driving current based on the data driving signal; in a detection stage, the detection unit is turned on based on the second scanning signal to output the detection driving current to the driving chip of the display panel through the detection line; the driving chip obtain the detection driving current of each sub-pixel to form a detection data table.

Before performing the detection operation on the display panel, the driving chip may scan and detect the sub-pixels row by row or column by column to obtain the detection driving current of each sub-pixel. For example, before the display panel displays a normal image at regular intervals or on every startup, the driving chip is connected to the detection unit through the detection line and performs a calculation based on the detection driving current, which is generated by the driving unit, detected through the detection unit in combination with an algorithm, thereby obtaining grayscales of the sub-pixels at different positions on the display panel. When the detection operation is performed, the light-emitting elements in the sub-pixels do not emit light.

At block S2: determining a compensation signal of each sub-pixel based on the detection driving current of the each sub-pixel.

Specifically, the driving chip obtains the detection driving current through the detection unit, performs a calculation in combination with the algorithm to determine a compensation signal of each sub-pixel, and compensates the data driving signal by the compensation signal to form a compensation data table.

At block S3: in condition of a display operation being performed, compensating a data driving signal of each sub-pixel through the compensation signal of the each sub-pixel, so as to drive the light-emitting element of the each sub-pixel to emit light correspondingly.

Specifically, when the display operation is performed, in a compensation stage, the pre-charging unit is turned on based on the first scanning signal to input the compensated data driving signal to the driving unit and save the signal, and the driving unit generates a corresponding display driving current based on the compensated data driving signal to drive the light-emitting element to emit light; when a display operation is performed, the driving chip of the display panel is in a high-impedance state during a period when the detection unit is turned on based on the second scanning signal Vscan, and the light-emitting element does not emit light; when the pre-charging unit is turned off based on the first scanning signal and the detection unit is turned off based on the second scanning signal, the path control unit is turned on based on the second scanning signal, and the light-emitting element emits light.

The driving method of the driving circuit provided by the present disclosure includes: in condition of a detection operation being performed, scanning and detecting sub-pixels row by row, and obtaining a detection driving current of each sub-pixel; determining a compensation signal of each sub-pixel based on the detection driving current of the each sub-pixel; and in condition of a display operation being performed, compensating the data driving signal of each sub-pixel through the compensation signal of the each sub-pixel, so as to drive the light-emitting element of the each sub-pixel to emit light correspondingly. By detecting and compensating the data driving signal of each sub-pixel before the display panel performs the display operation, the problem of uneven brightness of the display panel caused by different driving currents of multiple sub-pixels at different positions and at different times when the display panel performs a display operation is solved.

The above is only some embodiments of the present disclosure and is not intended to limit the scope of the present disclosure. Any equivalent structure or equivalent process transformation using the specification and the accompanying drawings of the present disclosure, or direct or indirect application in other related technical fields, is included in the scope of the present disclosure.

What is claimed is:

1. A driving circuit of a display panel, comprising a plurality of sub-pixels; wherein for each sub-pixel, the sub-pixel comprises:

a light-emitting element;

a pre-charging unit, configured to be connected to a data line to receive a data driving signal and configured to be connected to a first scanning line to receive a first scanning signal;

a driving unit, configured to be connected to the pre-charging unit and the light-emitting element and configured to be connected to a second scanning line to receive a second scanning signal;

a detection unit, connected to the driving unit; and a path control unit, connected between the driving unit and the light-emitting element and connected to a display driving line to receive a display signal;

wherein in condition of a detection operation being performed, the pre-charging unit is configured to receive the data driving signal through the data line, the driving unit is configured to generate a detection driving current based on the data driving signal, and the detection unit is configured to detect the detection driving current generated by the driving unit, such that the display panel determines a compensation signal of the sub-pixel based on the detection driving current and compensates the data driving signal based on the compensation signal;

in condition of a display operation being performed, the pre-charging unit is configured to receive the compensated data driving signal through the data line, and the driving unit is configured to generate a display driving current based on the compensated data driving signal to drive the light-emitting element to emit light;

wherein, in a pre-charging stage of the detection operation, the detection unit and the path control unit are turned off, the pre-charging unit is controlled by the first scanning signal controls to be turned on to receive the data driving signal, the driving unit generates the detection driving current based on the data driving signal;

in a detection stage of the detection operation, the path control unit is turned off, the pre-charging unit is controlled by the first scanning signal to be turned off, the detection unit is controlled by the second scanning signal to be turned on, and the detection unit is configured to detect the detection driving current generated by the driving unit to determine the compensation signal;

in a first stage of the display operation, the detection unit and the path control unit are turned off, the pre-charging unit is controlled by the first scanning signal to be turned on, the pre-charging unit receives the compensated data driving signal, and the driving unit generates the display driving current based on the compensated data driving signal;

in a second stage of the display operation, the path control unit is turned off, the pre-charging unit is controlled by the first scanning signal to be turned off, and the detection unit is controlled by the second scanning signal to be turned on; and in a third stage of the display operation, the pre-charging unit is controlled by the first scanning signal to be turned off, the detection unit is controlled by the second scanning signal to be turned off, and the path control unit is controlled by the display signal to be turned on to allow the light-emitting element to emit light, and a current flowing through the light-emitting element is a compensated current.

2. The driving circuit according to claim 1, wherein in condition of the detection operation being performed, the path control unit is configured to disconnect a loop in which the driving unit and the light-emitting element are located, and the detection unit is configured to detect the detection driving current generated by the driving unit to enable the display panel to determine the compensation signal;

in condition of the display operation being performed, the path control unit is configured to conduct the loop in which the driving unit and the light-emitting element are located, and the detection unit is in a high-impedance state; the driving unit is configured to generate the display driving current based on the compensated data driving signal, and the display driving current flows through the light-emitting element via the path control unit to drive the light-emitting element to emit light.

3. The driving circuit according to claim 2, wherein, the first scanning signal is configured to control whether the pre-charging unit is turned on;

the second scanning signal is configured to control whether the detection unit is turned on;

a turn-on period of the second scanning signal is later than a turn-on period of the first scanning signal.

4. The driving circuit according to claim 3, wherein the display signal is configured to determine whether the path control unit is turned on; a turn-on period of the display signal is later than the turn-on period of the second scanning signal.

5. The driving circuit according to claim 4, wherein an enabling period of the second scanning signal follows an enabling period of the first scanning signal; an enabling period of the display signal is later than the enabling period of the first scanning signal and the enabling period of the second scanning signal.

6. The driving circuit according to claim 3, wherein, in condition of the detection operation being performed, in a pre-charging stage, the pre-charging unit is turned on based on the first scanning signal to input the data driving signal to the driving unit and save the data driving signal, and the driving unit is configured to generate the detection driving current based on the data driving signal; in a detection stage, the detection unit is turned on based on the second scanning signal to output the detection driving current to a driving chip of the display panel through the detection line, thereby determining the compensation signal of the sub-pixel and compensating the data driving signal based on the compensation signal;

in condition of the display operation being performed, in a compensation stage, the pre-charging unit is turned on based on the first scanning signal to input the compensated data driving signal to the driving unit and save the compensated data driving signal, and the driving unit is configured to generate the display driving current based on the compensated data driving signal to drive the light-emitting element to emit light; the driving chip of the display panel is in a high-impedance state during a period when the detection unit is turned on based on the second scanning signal.

7. The driving circuit according to claim 2, wherein the pre-charging unit comprises:

a first switch, comprising a first terminal, a second terminal, and a control terminal; wherein the first terminal of the first switch is connected to the data line, the second terminal of the first switch is connected to the driving unit, and the control terminal of the first switch is configured to receive the first scanning signal.

8. The driving circuit according to claim 7, wherein the driving unit comprises:

a second switch, comprising a first terminal, a second terminal, and a control terminal; wherein the first terminal of the second switch is connected to a first voltage source, the second terminal of the second switch is connected to the detection unit, and the control terminal of the second switch is connected to the pre-charging unit; and a capacitor, comprising a first terminal and a second terminal; wherein the first terminal of the capacitor is connected to the first terminal of the second switch, and the second terminal of the capacitor is connected to the control terminal of the second switch.

9. The driving circuit according to claim 8, wherein the detection unit comprises:

a third switch, comprising a first terminal, a second terminal, and a control terminal; wherein the first terminal of the third switch is connected to the driving unit, the second terminal of the third switch is connected to the detection line, and the control terminal of the third switch is configured to receive the second scanning signal.

10. The driving circuit according to claim 9, wherein the path control unit comprises:

a fourth switch, comprising a first terminal, a second terminal, and a control terminal; wherein the first terminal of the fourth switch is connected to the driving unit, the second terminal of the fourth switch is connected to the light-emitting element, and the control terminal of the fourth switch is configured to receive a control signal.

11. The driving circuit according to claim 10, wherein the sub-pixel further comprises:

a third scanning line; and a fifth switch, comprising a first terminal, a second terminal, and a control terminal; wherein the first terminal of the fifth switch is connected to the second terminal of the fourth switch, the second terminal of the fifth switch is connected to the detection line, and the control terminal of the fifth switch is connected to the third scanning line to receive a third scanning signal; the third scanning signal is configured to control the fifth switch to be turned on.

12. The driving circuit according to claim 11, wherein, in response to the fourth switch being turned on, the third scanning signal controls the fifth switch to be turned on, the fifth switch detects the display driving current and is turned on based on the third scanning signal to output the display driving current to the driving chip through the detection line, thereby determining whether the display driving current is a preset display driving current;

in response to the driving chip detecting the display driving current, the fifth switch is turned off based on the third scanning signal.

13. A display panel, comprising:

a driving circuit, comprising a plurality of sub-pixels; wherein for each sub-pixel, the sub-pixel comprises:

a light-emitting element;

a pre-charging unit, configured to be connected to a data line to receive a data driving signal and configured to be connected to a first scanning line to receive a first scanning signal;

a driving unit, configured to be connected to the pre-charging unit and the light-emitting element and configured to be connected to a second scanning line to receive a second scanning signal;

a detection unit, connected to the driving unit; and a path control unit, connected between the driving unit and the light-emitting element and connected to a display driving line to receive a display signal;

wherein in condition of a detection operation being performed, the pre-charging unit is configured to receive the data driving signal through the data line, the driving unit is configured to generate a detection driving current based on the data driving signal, and the detection unit is configured to detect the detection driving current generated by the driving unit, such that the display panel determines a compensation signal of the sub-pixel based on the detection driving current and compensates the data driving signal based on the compensation signal;

in condition of a display operation being performed, the pre-charging unit is configured to receive the compensated data driving signal through the data line, and the driving unit is configured to generate a display driving current based on the compensated data driving signal to drive the light-emitting element to emit light;

wherein, in a pre-charging stage of the detection operation, the detection unit and the path control unit are turned off, the pre-charging unit is controlled by the first scanning signal controls to be turned on to receive the data driving signal, the driving unit generates the detection driving current based on the data driving signal;

in a detection stage of the detection operation, the path control unit is turned off, the pre-charging unit is controlled by the first scanning signal to be turned off, the detection unit is controlled by the second scanning signal to be turned on, and the detection unit is configured to detect the detection driving current generated by the driving unit to determine the compensation signal;

in a first stage of the display operation, the detection unit and the path control unit are turned off, the pre-charging unit is controlled by the first scanning signal to be turned on, the pre-charging unit receives the compensated data driving signal, and the driving unit generates the display driving current based on the compensated data driving signal;

in a second stage of the display operation, the path control unit is turned off, the pre-charging unit is controlled by the first scanning signal to be turned off, and the detection unit is controlled by the second scanning signal to be turned on; and in a third stage of the display operation, the pre-charging unit is controlled by the first scanning signal to be turned off, the detection unit is controlled by the second scanning signal to be turned off, and the path control unit is controlled by the display signal to be turned on to allow the light-emitting element to emit light, and a current flowing through the light-emitting element is a compensated current; and a driving chip, connected to the driving circuit; wherein the driving chip is configured to obtain the detection driving current from the driving circuit, obtain the compensation signal based on the detection driving signal, and compensate the data driving signal based on the compensation signal.

14. The display panel according to claim 13, wherein the driving chip is specifically configured to scan and detect the plurality of sub-pixels row by row or column by column to obtain the detection driving current of each sub-pixel.

15. The display panel according to claim 14, wherein the driving chip is specifically configured to obtain the detection driving current of each sub-pixel before the display panel displays a normal screen on every startup or before the display panel displays a next screen at regular intervals.

16. The display panel according to claim 13, wherein the driving chip is specifically configured to perform a calculation based on the detection driving current in combination with an algorithm to obtain grayscales of the plurality of sub-pixels at different positions on the display panel; and to compensate each grayscale, such that currents flowing through the light-emitting elements are the same when the grayscales at different positions are the same in condition of the display panel performing the display operation.

17. The driving circuit according to claim 13, wherein the sub-pixel further comprises:

a path control unit, connected between the driving unit and the light-emitting element;

wherein in condition of the detection operation being performed, the path control unit is configured to disconnect a loop in which the driving unit and the light-emitting element are located, and the detection unit is configured to detect the detection driving current generated by the driving unit to enable the display panel to determine the compensation signal;

in condition of the display operation being performed, the path control unit is configured to conduct the loop in which the driving unit and the light-emitting element are located, and the detection unit is in a high-impedance state; the driving unit is configured to generate the display driving current based on the compensated data driving signal, and the display driving current flows through the light-emitting element via the path control unit to drive the light-emitting element to emit light.

18. The driving circuit according to claim 13, wherein, the pre-charging unit is connected to a first scanning line to receive a first scanning signal, so as to control whether the pre-charging unit is turned on based on the first scanning signal;

the detection unit is connected to a second scanning line to receive a second scanning signal, so as to control whether the detection unit is turned on based on the second scanning signal;

a turn-on period of the second scanning signal is later than a turn-on period of the first scanning signal.

19. The driving circuit according to claim 18, wherein, in condition of the detection operation being performed, in a pre-charging stage, the pre-charging unit is turned on based on the first scanning signal to input the data driving signal to the driving unit and save the data driving signal, and the driving unit is configured to generate the detection driving current based on the data driving signal; in a detection stage, the detection unit is turned on based on the second scanning signal to output the detection driving current to a driving chip of the display panel through the detection line, thereby determining the compensation signal of the sub-pixel and compensating the data driving signal based on the compensation signal;

in condition of the display operation being performed, in a compensation stage, the pre-charging unit is turned on based on the first scanning signal to input the compensated data driving signal to the driving unit and save the compensated data driving signal, and the driving unit is configured to generate the display driving current based on the compensated data driving signal to drive the light-emitting element to emit light; the driving chip of the display panel is in a high-impedance state during a period when the detection unit is turned on based on the second scanning signal.

20. A driving method for a driving circuit, wherein the driving circuit comprises a plurality of sub-pixels arranged in array, and the method comprises:

in condition of a detection operation being performed, scanning and detecting the plurality of sub-pixels row by row, and obtaining a detection driving current of each sub-pixel;

determining a compensation signal of each sub-pixel based on the detection driving current of the each sub-pixel; and in condition of a display operation being performed, compensating a data driving signal of each sub-pixel based on the compensation signal of the each sub-pixel, so as to drive a light-emitting element of the each sub-pixel to emit light, wherein the each sub-pixel comprises:

the light-emitting element;

a pre-charging unit, configured to be connected to a data line to receive a data driving signal and configured to be connected to a first scanning line to receive a first scanning signal;

a driving unit, configured to be connected to the pre-charging unit and the light-emitting element and configured to be connected to a second scanning line to receive a second scanning signal;

a detection unit, connected to the driving unit; and a path control unit, connected between the driving unit and the light-emitting element and connected to a display driving line to receive a display signal;

wherein in condition of a detection operation being performed, the pre-charging unit is configured to receive the data driving signal through the data line, the driving unit is configured to generate a detection driving current based on the data driving signal, and the detection unit is configured to detect the detection driving current generated by the driving unit, such that the display panel determines a compensation signal of the sub-pixel based on the detection driving current and compensates the data driving signal based on the compensation signal;

in condition of a display operation being performed, the pre-charging unit is configured to receive the compensated data driving signal through the data line, and the driving unit is configured to generate a display driving current based on the compensated data driving signal to drive the light-emitting element to emit light;

wherein, in a pre-charging stage of the detection operation, the detection unit and the path control unit are turned off, the pre-charging unit is controlled by the first scanning signal controls to be turned on to receive the data driving signal, the driving unit generates the detection driving current based on the data driving signal;

in a detection stage of the detection operation, the path control unit is turned off, the pre-charging unit is controlled by the first scanning signal to be turned off, the detection unit is controlled by the second scanning signal to be turned on, and the detection unit is configured to detect the detection driving current generated by the driving unit to determine the compensation signal;

in a first stage of the display operation, the detection unit and the path control unit are turned off, the pre-charging unit is controlled by the first scanning signal to be turned on, the pre-charging unit receives the compensated data driving signal, and the driving unit generates the display driving current based on the compensated data driving signal;

in a second stage of the display operation, the path control unit is turned off, the pre-charging unit is controlled by the first scanning signal to be turned off, and the detection unit is controlled by the second scanning signal to be turned on; and in a third stage of the display operation, the pre-charging unit is controlled by the first scanning signal to be turned off, the detection unit is controlled by the second scanning signal to be turned off, and the path control unit is controlled by the display signal to be turned on to allow the light-emitting element to emit light, and a current flowing through the light-emitting element is a compensated current.

* * * * *